United States Patent [19]

Tomanovits

[11] Patent Number: 5,035,102

[45] Date of Patent: Jul. 30, 1991

[54] METHODS AND APPARATUS FOR APPLYING C-SHAPED INNERFRAMES TO CIGARETTE BUNDLES

[75] Inventor: John Tomanovits, Richmond, Va.

[73] Assignee: Phillip Morris Incorporated, Richmond, Va.

[21] Appl. No.: 584,803

[22] Filed: Sep. 19, 1990

[51] Int. Cl.[5] ..... B56B 11/08

[52] U.S. Cl. ..... 53/397; 53/466; 53/563; 53/590; 53/209

[58] Field of Search ..... 53/397, 466, 207, 209, 53/399, 176, 575, 590, 563

[56] References Cited

U.S. PATENT DOCUMENTS

| | | | |
|---|---|---|---|
| 2,933,830 | 4/1960 | Gentry | 53/209 |
| 2,986,857 | 6/1961 | Ganz | 53/48 |
| 2,998,685 | 9/1961 | Ganz | 53/48 |
| 3,220,155 | 11/1965 | Sherman | 53/48 |
| 3,417,544 | 12/1968 | Grevich | 53/209 X |
| 4,559,758 | 12/1985 | Gamberini | 53/207 |
| 4,596,112 | 6/1986 | B5uckley | 53/207 X |
| 4,708,704 | 11/1987 | Focke et al. | 493/151 |
| 4,730,442 | 3/1988 | Focke et al. | 53/579 |
| 4,753,383 | 6/1988 | Focke et al. | 229/160.1 |
| 4,753,384 | 6/1988 | Focke et al. | 229/160.1 |
| 4,843,798 | 7/1989 | Focke et al. | 53/453 |

FOREIGN PATENT DOCUMENTS

| | | | |
|---|---|---|---|
| 136076 | 4/1985 | European Pat. Off. | 53/207 |
| 3615827 | 11/1987 | Fed. Rep. of Germany . | |
| 3615828 | 11/1987 | Fed. Rep. of Germany . | |

*Primary Examiner*—John Sipos

*Attorney, Agent, or Firm*—Robert R. Jackson

[57] ABSTRACT

A C-shaped innerframe is preformed and then applied to a preformed cigarette bundle as part of a cigarette packing operation. The preformed innerframe first contacts the bundle with the back of the C in contact with the front surface of the bundle, and with the arms of the C adjacent the sides of the bundle and projecting rearwarly behind the rear surface of the bundle. Thereafter, the arms of the C are brought in against the side and rear surfaces of the bundle to complete application of the innerframe to the bundle.

11 Claims, 5 Drawing Sheets

FIG. 2
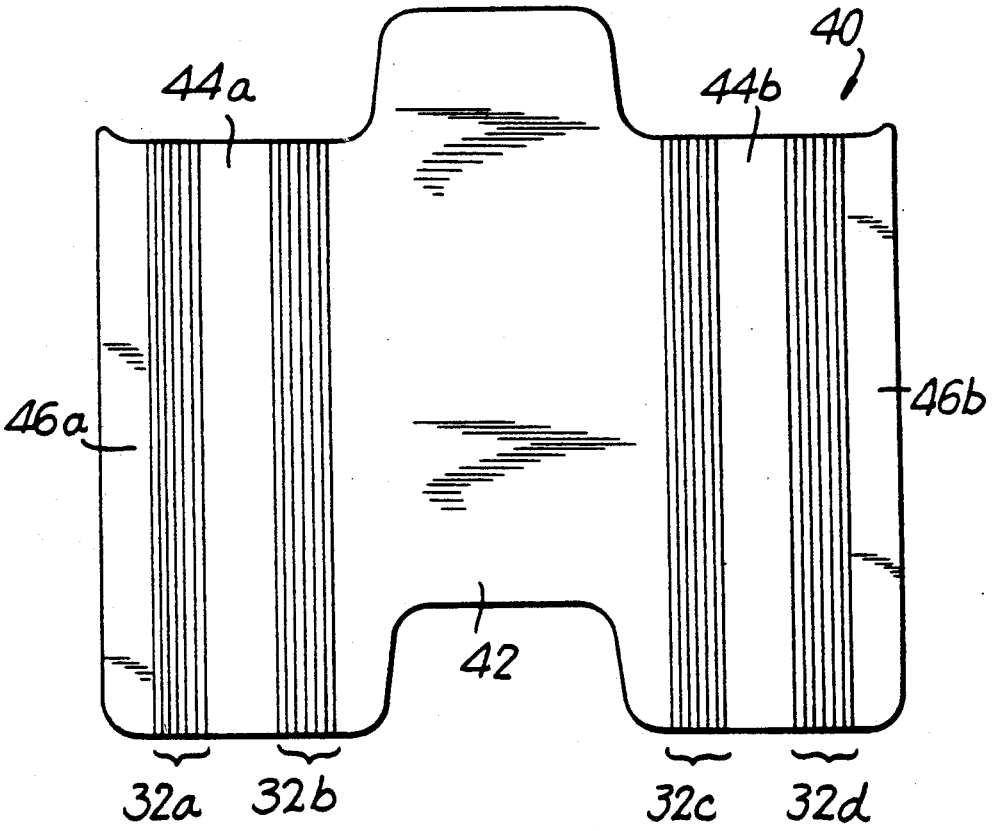
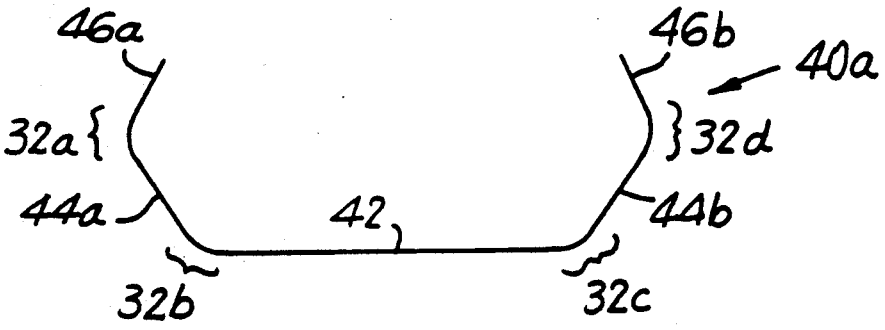
FIG. 3

METHODS AND APPARATUS FOR APPLYING C-SHAPED INNERFRAMES TO CIGARETTE BUNDLES

BACKGROUND OF THE INVENTION

This invention relates to cigarette packing methods and apparatus, and more particularly to methods and apparatus for applying a C-shaped innerframe to a cigarette bundle as part of a cigarette packing operation.

One of the more popular cigarette packages is a box in which the cigarettes stand upright and are accessed by pivoting back a box top or lid. To help keep the lid firmly and neatly closed except when deliberately opened, the box typically contains a cardboard innerframe which extends up from inside the front and side walls of the lower main portion of the box and which interferes somewhat with the pivoting of the lid.

In some boxes it has been found that an innerframe which projects up only from the front and sides of the main portion of the box is not strong or stable enough to reliably provide the desired interference with motion of the top. Although also possible in other box shapes, this has been found to be particularly true in boxes with rounded corners. In such cases it has been found that the innerframe performs better if it is additionally provided with rear flaps inside the rear wall of the lower main portion of the box. These rear flaps are extensions of the side walls of the innerframe and may also project up from the main portion of the box. These flaps help to stabilize the innerframe in the box and to brace or reinforce the side walls (and hence the front wall) of the innerframe. All of these effects enable the innerframe to more reliably provide the desired interference with opening of the lid.

Innerframes without rear flaps have a generally U-shaped cross section when viewed from the top of the box. Such innerframes are relatively easy to apply to a cigarette bundle before making up the box around the bundle/innerframe combination. Machines for performing these operations are well known and are commercially available. Innerframes with rear flaps, however, have a more complicated C-shaped cross section when viewed from the top of the box. Innerframes with this shape cannot be applied to a cigarette bundle with the known machines.

In view of the foregoing, it is an object of this invention to provide improved cigarette packing methods and apparatus.

It is a more particular object of the invention to provide methods and apparatus for applying a C-shaped innerframe to a cigarette bundle as part of a cigarette packing operation.

SUMMARY OF THE INVENTION

These and other objects of the invention are accomplished in accordance with the principles of the invention by methods and apparatus in which an innerframe, which has been given a generally C-shaped cross section, is applied to a cigarette bundle with the back of the C in contact with the front of the bundle, and with the arms of the C adjacent the sides of the bundle so that the rear flaps extend beyond the rear of the bundle. The bundle and the innerframe are then moved (parallel to the longitudinal axes of the cigarettes) relative to folding surfaces or edges which are substantially in the plane of the rear of the bundle. These edges are initially far enough apart to admit the bundle and innerframe between them, but these edges converge toward one another in the direction of motion of the bundle and innerframe, and finally extend under the rear of the bundle. Accordingly, as the bundle and innerframe move relative to these edges, the edges pull the side walls of the innerframe in against the sides of the bundle and then push the rear flaps against the rear of the bundle.

Further features of the invention, its nature and various advantages will be more apparent from the accompanying drawings and the following detailed description of the preferred embodiments.

BRIEF DESCRIPTION OF THE DRAWINGS

FIG. 2 shows an innerframe blank which is produced and then used in the apparatus shown in FIG. 1.

FIG. 3 is a partial sectional view taken along the line 3—3 in FIG. 1 showing just the innerframe.

DETAILED DESCRIPTION OF THE PREFERRED EMBODIMENTS

Although the invention can be carried out in many other ways, the invention will be fully understood from an explanation of its implementation as a modification of a hinge-lid cigarette packer which is commercially available from Molins Limited of Saunderton, High Wycombe, Bucks, England. Similarly, although the invention is applicable to cigarette packs having other shapes such as square-cornered packs, the invention will be fully understood from the following explanation of its application to cigarette packs having rounded corners.

Figure 1:
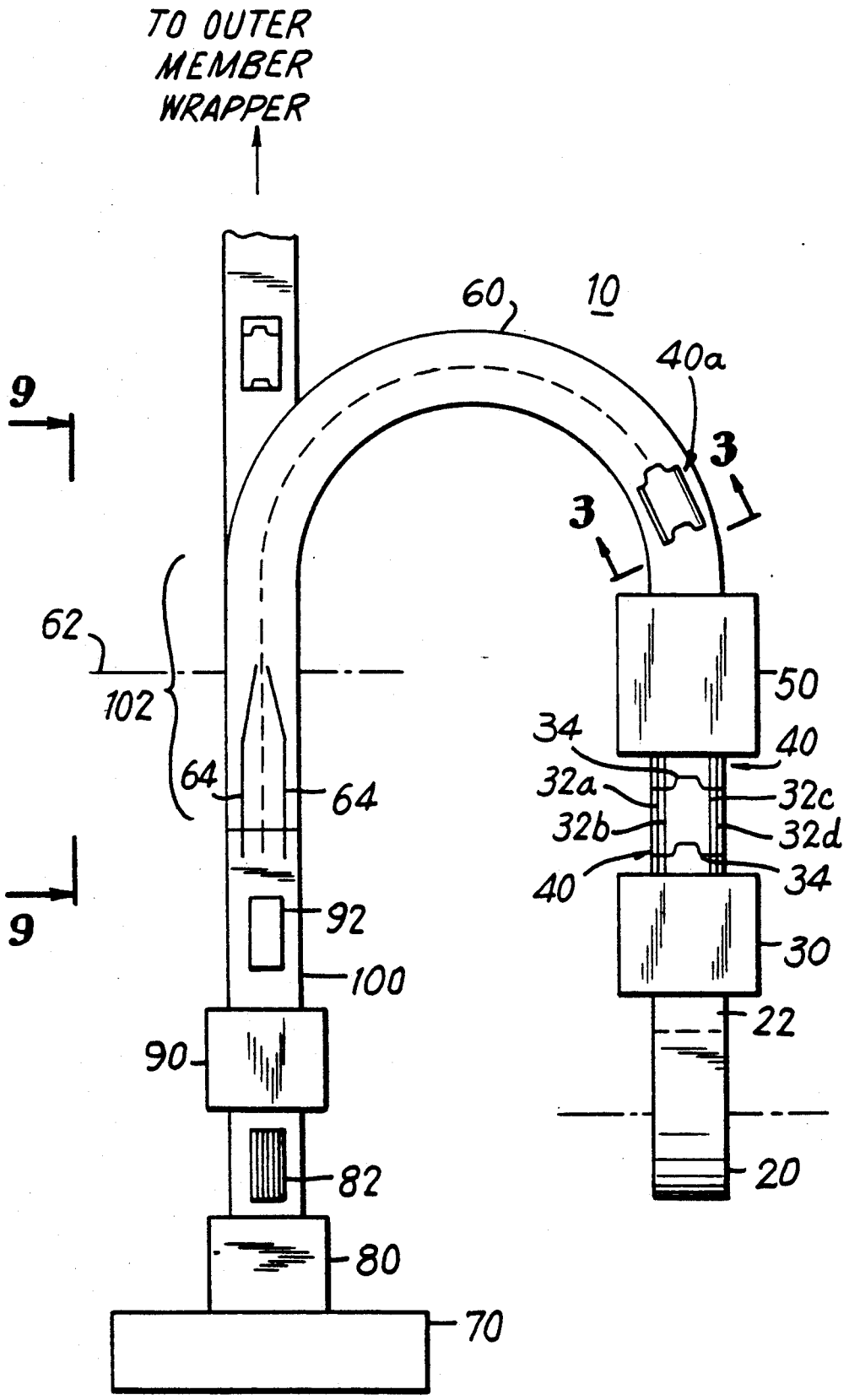
FIG. 1 is a simplified, partial, plan view of a cigarette packer which has been modified in accordance with this invention.

A Molins hinge-lid cigarette packer 10 which has been modified in accordance with this invention is shown in FIG. 1. Innerframe material 22 is fed into packer 10 in a continuous strip from supply reel 20. In head 30 this strip is scored longitudinally in each of four laterally spaced regions 32*a–d* which will correspond respectively to the four rounded corners of the finished pack. Multiple closely spaced score lines are provided in each of regions 32. The scored strip is then cut or substantially cut transversely as at 34 to define the top and bottom of each innerframe blank 40. A typical blank 40 is shown in more detail in FIG. 2 and includes front panel 42, side panels 44*a* and 44*b*, and rear flaps 46*a* and 46*b*. Rear flap 46*a* is joined to side panel 44*a* by scored region 32*a*. Side panel 44*a* is joined to front panel 42 by scored region 32*b*. Front panel 42 is joined to side panel 44*b* by scored region 32*c*. And side panel 44*b* is joined to rear flap 46*b* by scored region 32*d*. The stream of scored and cut blanks from head 30 is fed to preformer 50.

Preformer 50—which may be constructed as shown in concurrently filed, commonly assigned U.S. Pat. application Ser. No. 585,224, which is hereby incorporated by reference herein—bends each blank 40 so that the preformed blanks 40*a* exit from preformer 50 with the generally C-shaped cross section shown in FIG. 3. Conveyor 60 conveys the preformed blanks around to the cigarette bundle line which will now be described.

Cigarettes ready for bundling and packing are supplied to conventional bundler 80 from conventional cigarette hopper 70. Bundler 80 assembles the appropriate number of cigarettes (e.g., 20) into appropriately sized and shaped bundles 82 which are then conveyed one after another to conventional wrapper 90. Wrapper 90 wraps each bundle in foil to produce foil-wrapped bundles 92 which are then conveyed to the junction of the bundle line with conveyor 60. Note that at this junction the bed 100 on which the cigarette bundles 92 are travelling is below conveyor 60. Note also that the rear of each bundle (in the finished packs) rests on bed 100.

Figure 9:
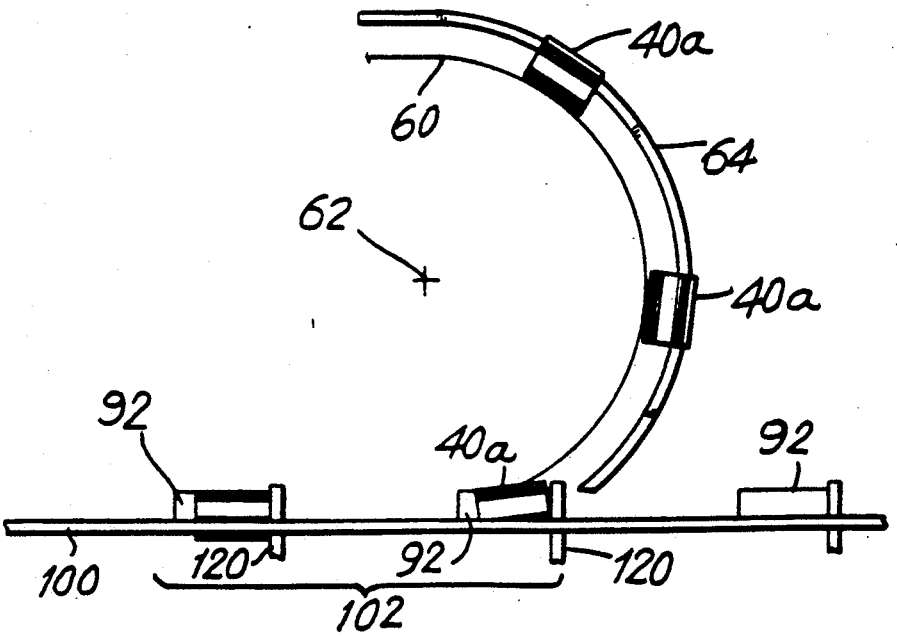
FIG. 9 is simplified, partial, elevational view taken along the line 9—9 in FIG. 1.

At the end of conveyor 60 adjacent to the cigarette bundle line, conveyor 60 conveys each preformed innerframe blank 40*a* so that it moves as though passing circumferentially over the surface of a drum whose longitudinal axis is indicated by the line 62 (see also FIG. 9). This causes each blank to turn over so that the previously upstanding arms of the C-shape (as in FIG. 3) now project downwardly. At least along this portion of conveyor 60, the arms of each blank are held apart by guides 64. Motion of the blanks about axis 62 also causes each blank to begin to move in the same direction as the cigarette bundles on bed 100. The spacing and synchronization between the cigarette bundles on bed 100 and the preformed blanks on conveyor 60 are such that an innerframe is thereby deposited on the front of each cigarette bundle. At this point conveyor 60 releases the innerframe so that it can continue to travel along bed 100 with the associated bundle.

Figure 4:
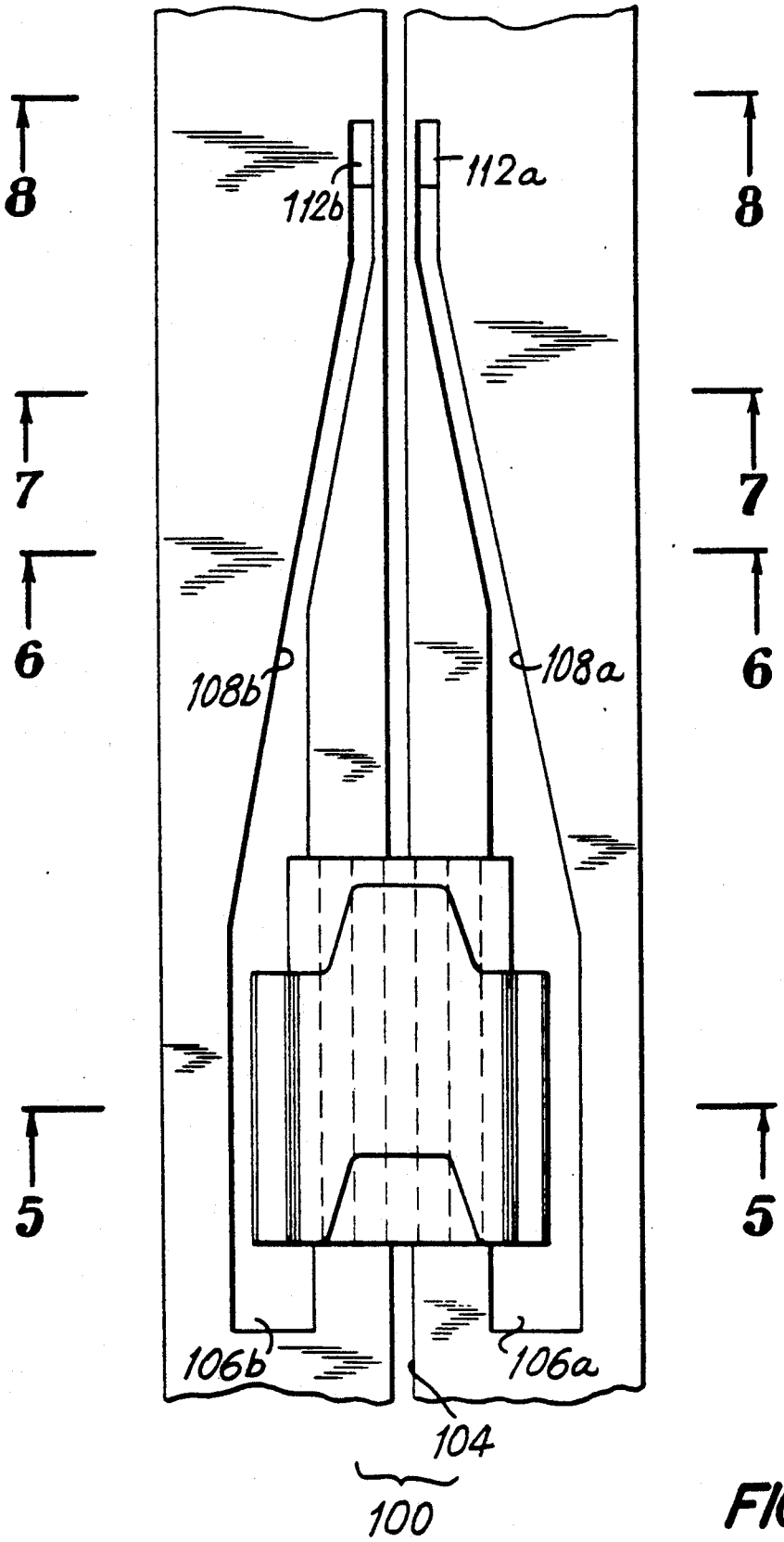
FIG. 4 is an enlarged, but still simplified and partial, plan view of a portion of the apparatus of FIG. 1 with a portion of the FIG. 1 apparatus removed to show certain details which are not visible in FIG. 1.
Figure 5:
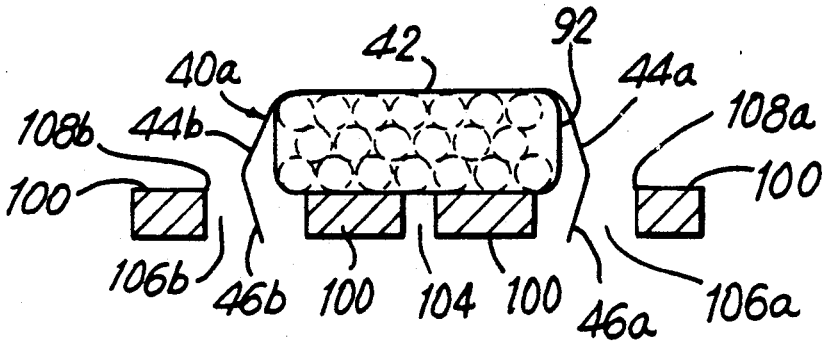
FIG. 5 is a sectional view taken along the line 5—5 in FIG. 4.

The region of bed 100 indicated generally by bracket 102 in FIGS. 1 and 9 is shown in more detail (with conveyor 60 removed) in FIG. 4. Bed 100 may have a central longitudinal slot 104 for allowing a pusher 120 (shown only in FIG. 9), which pushes bundle 92 (and later bundle 92 and innerframe 40*a*) along the bed, to be driven from below the bed. In addition, bed 100 has two other generally longitudinal slots 106*a* and 106*b* disposed symmetrically on each side of the central longitudinal axis of the bed. In the upstream region (where the sectional view shown in FIG. 5 is taken) slots 106 are relatively wide and relatively widely spaced from one another transverse to the longitudinal axis of the bed. In particular, in this region slots 106 are below the side walls of bundle 92. As shown in FIG. 5, this allows the arms of the C-shaped innerframe 40*a* to hang down below the upper surface of bed 100 when the innerframe is first applied to the bundle by conveyor 60.

Figure 6:
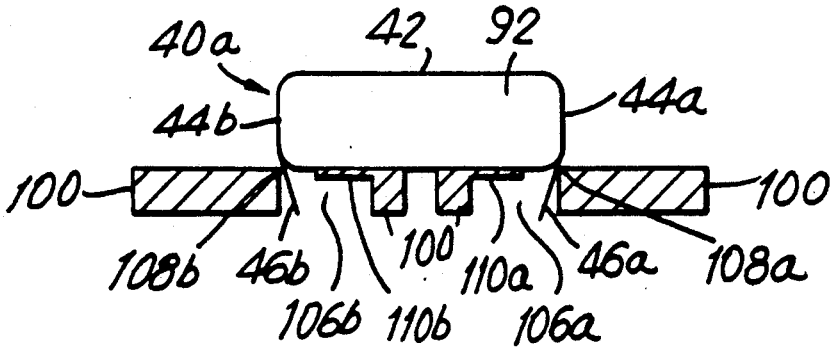
FIGS. 6–8 are sectional views taken respectively along the lines 6—6, 7—7, and 8—8 in FIG. 4 but showing the condition of the cigarette bundle and innerframe as those elements move to each of the depicted sections.

Downstream from section 5—5, slots 106*a* and 106*b*—and especially the upper outside edges 108*a* and 108*b* of those slots—begin to converge toward one another in the direction in which the bundle and innerframe are moved along bed 100. As a consequence of this convergence and the movement of the bundle and innerframe along bed 100, edges 108 soon begin to contact the arms of the innerframe and to pull innerframe side walls 44*a* and 44*b* in against the associated side surfaces of the bundle. This is shown in FIG. 6. Note also in FIG. 6 that at about section 6—6 the underside of bed 100 on the side of each slot opposite edges 108 begins to be undercut as at 110*a* and 110*b* to allow rear flaps 46*a* and 46 *b* to begin to fold up toward the rear surface of bundle 92.

Figure 7:
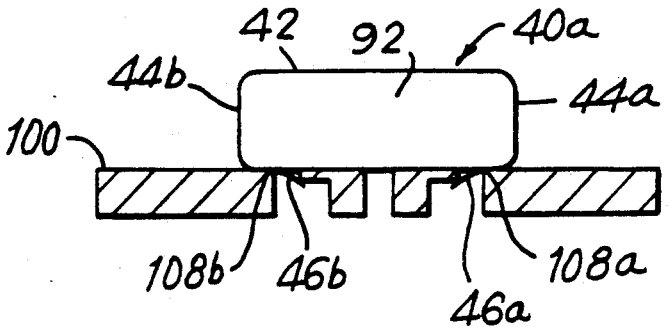

As bundle 92 and innerframe 40*a* continue to move along bed 100, and as edges 108*a* and 108*b* continue to converge, edges 108 begin to push rear flaps 46*a* and 46*b* up against the rear of bundle 92 as shown in FIG. 7.

Figure 8:
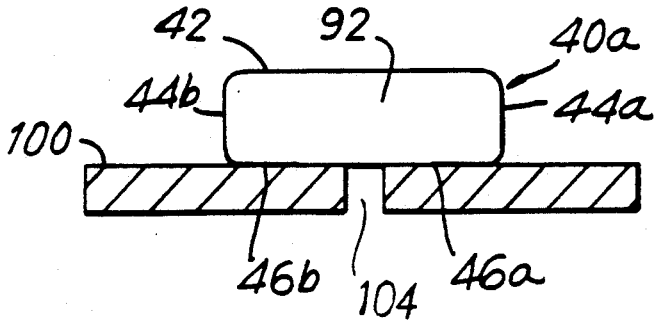

Finally, rear flaps 46*a* and 46*b* are completely up against the rear surface of the bundle as shown in FIG. 8, and slots 106 are no longer needed. Accordingly, slots 106 end just upstream of section 8—8. To ensure that the downstream ends of slots 106 do not snag the leading end of bundle 92, the downstream ends of the slots may be angled or ramped up to the top surface of bed 100 as shown at 112*a* and 112*b* in FIG. 4.

Returning to FIG. 1, after leaving above-described region 102, each bundle 92 and its completely applied innerframe are conveyed on to further conventional apparatus (not shown) which wraps an outer member around the bundle and innerframe to produce a substantially finished cigarette pack.

It will b understood that the foregoing is merely illustrative of the principles of this invention, and that various modifications can be implemented by those skilled in the art without departing from the scope and spirit of the invention. For example, although innerframe 40*a* is shown having rounded corners, a single score line at each corner 32, rather than several closely spaced score lines as shown in the drawings, will tend to produce a square-cornered innerframe.

What is claimed is:

1. Apparatus for wrapping a cigarette pack innerframe around a previously assembled bundle of cigarettes, said bundle having a front surface, a rear surface substantially parallel to and spaced from said front surface, and a pair of side surfaces which are substantially parallel to and spaced from one another and which interconnect side margins of said front and rear surfaces, said innerframe having a front wall which is to at least partly cover said front surface, a pair of side walls, each of which is to at least partly cover a respective associated one of said side surfaces and each of which is connected to a respective one of opposite side margins of said front wall, and a pair of rear flaps each of which is to partly cover said rear surface and each of which is connected to a respective one of said side walls along a side margin of said side wall which is spaced from the side margin of the front wall to which that side wall is connected, said innerframe being prebent separate from said bundle at all four of said side margins of said innerframe so that the cross section of said innerframe perpendicular to said innerframe side margins is approximately C-shaped, said apparatus comprising:

means for supporting said bundle so that the front and side surfaces of said bundle are exposed;

means for holding said prebent innerframe open so that the edges of said rear flaps which are parallel to but spaced from said side margins are spaced apart by a distance greater than the spacing between said side surfaces;

means for placing said prebent but held open innerframe on said bundle so that each of said rear flaps can pass outside of a respective one of said side surfaces in order to project behind said rear surface, and so that said front wall rests on said front surface;

means for moving said bundle and said innerframe together in a predetermined direction along a longitudinal axis which is substantially parallel to said side margins of said front and rear surfaces; and means for guiding said rear flaps forward one another and into contact with said rear surface as said bundle and said innerframe move along said longitudinal axis to at least partly cover said rear surface inserted.

2. The apparatus defined in claim 1 wherein said means for guiding comprises:

a pair of edges which are substantially co-planar with said rear surface and which are synclinal in said predetermined direction, each of said edges having an upstream portion where said edges are most remote from one another and a downstream portion where said edges are closest to one another, said upstream portions being far enough apart to allow said bundle and said innerframe to pass between said upstream portions without substantially contacting said upstream portions, and both of said downstream portions being adjacent said rear surface so that as said bundle and said innerframe move along said longitudinal axis, said edges engage said rear flaps and push them toward one another and against said rear surface.

3. The apparatus defined in claim 2 wherein said means for supporting said bundle comprises:

a bed for supporting a portion of said rear surface.

4. The apparatus defined in claim 3 wherein each of said edges is an edge of a respective associated one of a pair of slots formed in said bed.

5. The apparatus defined in claim 4 wherein each of said edges is the edge of the side of the associated slot which is remote from the other of said slots.

6. The method of wrapping a cigarette pack innerframe around a previously assembled bundle of cigarettes, said bundle having a front surface, a rear surface substantially parallel to sand spaced from said front surface, and a pair of side surfaces parallel to and spaced from one another and which interconnect side margins of said front and rear surfaces, said innerframe having a front wall which is to at least partly cover said front surface, a pair of side walls each of which is to at least partly cover a respective associated one of said side surfaces and each of which is connected to a respective one of opposite side margins of said front wall, and a pair of rear flaps each of which is to partly cover said rear surface and each of which is connected to a respective one of said side walls along a side margin of said side wall which is spaced from the side margin of the front wall to which that side wall is connected, said innerframe being prebent separate from said bundle at all four of said side margins of said innerframe so that the cross section of said innerframe perpendicular to said innerframe side margins is approximately C-shaped, said method comprising the steps of:

supporting said bundle so that the front and side surfaces of said bundle are exposed;

holding said prebent innerframe open so that the edges of said rear flaps which are parallel to but spaced from said side margins are spaced apart by a distance greater than the spacing between said side surfaces;

placing said prebent but held open innerframe on said bundle so that each of said rear flanges can pass outside of a respective one of said side surfaces in order to project behind said rear surface, and so that said front wall rests on said front surface;

moving said bundle and said innerframe together in a predetermined direction along a longitudinal axis which is substantially parallel to said side margins of said front and rear surfaces; and guiding said rear flaps toward one another and into contact with said rear surface as said bundle and said innerframe move along said longitudinal axis to at least partly cover said rear surface.

7. The method defined in claim 6 wherein said guiding step comprises the step of:

providing a pair of edges which are substantially co-planar with said rear surface and which are synclinal in said predetermined direction, each of said edges having an upstream portion where said edges are most remote from one another and a downstream portion where said edges are closest to one another, said upstream portions being far enough apart to allow said bundle and said innerframe to pass between said upstream portions without substantially contacting said upstream portions, and both of said downstream portions being in contact with said rear surface so that as said bundle and said innerframe move along said longitudinal axis, said edges engage said rear flaps and push them toward one another and against said rear surface.

8. Apparatus for wrapping a bundle of cigarettes in a C-shaped innerframe comprising:

means for preforming an innerframe into an approximately C-shape, a front wall of the innerframe being the back of the C, and each of the arms of the C including a respective one of two side walls and a respective one of two rear flaps of the innerframe, said preformed innerframe being bent where each of said side walls joins said front wall and where each of said rear flaps joins the associated side wall;

means for separately preforming a bundle of cigarettes having a front surface, a rear surface, and two side surfaces;

means for holding said preformed innerframe open so that the edges of said rear flaps which are remote from the side walls are spaced apart by a distance greater than the spacing between said side surfaces;

means for applying said preformed but held open innerframe to said bundle so that said front wall of said innerframe is in contact with said front surface and so that each of said arms of the C extends adjacent a respective associated one of said side surfaces and projects rearwardly of said rear surface; and means for pressing each of said side walls in against the associated one of said side surfaces and both of said rear flaps in against said rear surface to at least partly cover said rear surface.

9. The apparatus defined in claim 8 wherein said means for pressing comprises:

a pair of opposing edges disposed substantially in a plane defined by said rear surface; and means for producing relative motion between said bundle and said innerframe, on the one hand, and said edges on the other hand, said relative motion being in a predetermined direction along a substantially longitudinal axis in said plane, said longitudinal axis being substantially parallel to said front, rear, and side surfaces, said edges being disposed substantially symmetrically on respective opposite sides of said longitudinal axis from upstream portions where said edges are relatively far apart to downstream portions where said edges gradually converge toward one another, the spacing between said upstream portions being greater than the spacing of the arms of the C and the smallest spacing between said downstream portions being not greatly more than the spacing between said rear flaps when said innerframe is fully wrapped around said bundle so that as said bundle and said innerframe move relative to said edges, said edges move said side walls in against said side surfaces and also move said rear flaps in against said rear surface.

10. The method of wrapping a bundle of cigarettes in a C-shaped innerframe comprising the steps of:

preforming an innerframe into an approximately C-shape, a front wall of the innerframe being the back of the C, and each of the arms of the C including a respective one of two rear flaps of the innerframe, said preformed innerframe being bent where each of said side walls joins said front wall and where each of said rear flaps joins the associated side wall;

separately performing a bundle of cigarettes having a front surface, a rear surface, and two side surfaces;

holding said preformed innerframe open so that the edges of said rear flaps which are remote from the side walls are spaced apart by a distance greater than the spacing between said side surfaces;

applying said preformed but held open innerframe to said bundle so that said front wall of said innerframe is in contact with said front surface and so that each of said arms of the C extends adjacent a respective associated one of said side surfaces and projects rearwardly of said rear surface; and pressing each of said side walls in against the associated one of said side surfaces and both of said rear flaps in against said rear surface to at least partly cover said rear surface.

11. The method defined in claim 10 wherein said pressing step comprises the steps of:

providing a pair of opposing edges disposed substantially in a plane defined by said rear surface; and moving said bundle and said innerframe relative to said edges in a predetermined direction along a substantially longitudinal axis in said plane, said longitudinal axis being substantially parallel to said front, rear, and side surfaces, said edges being disposed substantially symmetrically on respective opposite sides of said longitudinal axis and extending along said axis from upstream portions where said edges are relatively far apart to downstream portions where said edges gradually converge toward one another, the spacing between said upstream portions being greater than the spacing of the arms of the C, and the smallest spacing between said downstream portions being not greatly more than the spacing between said rear flaps when said innerframe is fully wrapped around said bundle so that as said bundle and said innerframe move relative to said edges, said edges move said side walls in against said side surfaces and also move said rear flaps in against said rear surface.

* * * * *